US007942543B2

(12) United States Patent
Ritter

(10) Patent No.: US 7,942,543 B2
(45) Date of Patent: May 17, 2011

(54) LIGHT EMITTING HEAD ACCESSORY

(76) Inventor: Michael Larry Ritter, Lindstrom, MN (US)

( * ) Notice: Subject to any disclaimer, the term of this patent is extended or adjusted under 35 U.S.C. 154(b) by 313 days.

(21) Appl. No.: 12/364,120

(22) Filed: Feb. 2, 2009

(65) Prior Publication Data

US 2009/0241243 A1 Oct. 1, 2009

Related U.S. Application Data

(63) Continuation-in-part of application No. 29/304,052, filed on Mar. 25, 2008, now abandoned.

(51) Int. Cl.
*F21V 21/08* (2006.01)
*H05B 37/00* (2006.01)

(52) U.S. Cl. ..... 362/103; 362/105; 362/570; 362/561; 315/312; 315/307

(58) Field of Classification Search ..... 362/103, 362/105, 106, 570, 561, 812; 315/312, 316, 315/291–298, 362, 307; 340/573, 693
See application file for complete search history.

(56) References Cited

U.S. PATENT DOCUMENTS

| | | | | |
|---|---|---|---|---|
| D96,026 | S | 6/1935 | Eisenberg | |
| D135,996 | S | 7/1943 | Gross | |
| D136,972 | S | 1/1944 | Hodge | |
| 2,875,447 | A | 3/1959 | Goldmerstein | |
| 5,138,720 | A | 8/1992 | Campbell | |
| D340,345 | S | 10/1993 | Russell | |
| D357,343 | S | 4/1995 | O'Neal | |
| D365,432 | S | 12/1995 | Buccelli | |
| 5,485,358 | A | 1/1996 | Chien | |
| 5,515,247 | A * | 5/1996 | Cheung et al. | 362/84 |
| D382,989 | S | 9/1997 | Simpson | |
| 5,821,858 | A * | 10/1998 | Stone | 340/573.1 |
| D409,357 | S | 5/1999 | Hirata | |
| 6,018,821 | A | 2/2000 | Adams | |
| D432,718 | S | 10/2000 | Sartena | |
| D478,409 | S | 8/2003 | Lesley | |
| 6,719,437 | B2 | 4/2004 | Lary et al. | |
| 6,721,962 | B1 | 4/2004 | Polaire | |
| D501,281 | S | 1/2005 | Kole | |
| D501,705 | S | 2/2005 | Hathaway | |
| 6,935,761 | B2 * | 8/2005 | Vanderschuit | 362/106 |
| 7,052,154 | B2 | 5/2006 | Vanderschuit | |
| 7,071,828 | B2 * | 7/2006 | Wong | 340/573.1 |
| 7,086,749 | B1 * | 8/2006 | Hanley | 362/105 |
| 7,405,715 | B2 * | 7/2008 | Guzman et al. | 345/83 |
| 7,429,965 | B2 * | 9/2008 | Weiner | 345/30 |
| 7,494,237 | B1 * | 2/2009 | Cheung | 362/103 |
| 2006/0197474 | A1 * | 9/2006 | Olsen | 315/312 |

* cited by examiner

*Primary Examiner* — Ali Alavi
(74) *Attorney, Agent, or Firm* — Merchant & Gould P.C.

(57) ABSTRACT

A light emitting head accessory includes an array of light emission devices positioned on a front surface of a strip of flexible material, a logic circuit, a power source, and an input device. The logic circuit is connected to the array of light emission devices and programmed to create arrangements on the array of light emission devices by illuminating a plurality of light emission devices in the array of light emission devices. The power source provides power to the array of light emission devices and the logic circuit. The input device is connected to and instructs the logic circuit to display various arrangements on the array of light emission devices.

24 Claims, 13 Drawing Sheets

LIGHT EMITTING HEAD ACCESSORY

CROSS REFERENCE TO RELATED APPLICATIONS

This application is a continuation-in-part of U.S. patent application Ser. No. 29/304,052, filed Mar. 25, 2008, the disclosure of which is hereby incorporated by reference in its entirety.

BACKGROUND OF THE INVENTION

Spectators are continually looking for creative ways to express themselves while attending sporting events. Fans will go to great lengths to show their support for a team or a player. While cheering loudly for a team is helpful, some fans find that cheering alone is inadequate. In addition to cheering, some fans will wear simulated jerseys emulating their favorite players, paint their faces, use noisemakers, wear team themed hats, or have other signs and props. Team themed hats come in various embodiments, ranging from standard team themed athletic caps to oversized foam team themed hats and accessories. While oversized foam team themed hats and accessories are useful in expressing oneself, they can become nuisances and obstruct the view for other spectators sitting behind the wearer if they are too large or distracting.

SUMMARY OF THE INVENTION

In general terms, this disclosure is directed to a light emitting head accessory having an array of light emission devices supported about an exterior surface of a strip of flexible material. The array of light emission devices is electrically coupled to a logic circuit which controls the illumination of selected light emission devices in order to display patterns or arrangements thereon.

One aspect is a light emitting head accessory. The light emitting head accessory includes a strip of flexible material having a front surface, the strip sized to fit around a head of a person; an array of light emission devices positioned on the front surface; a logic circuit electrically coupled to the array of light emission devices and programmed to selectively illuminate at least some of the light emission devices in the array of light emission devices to form an arrangement of illuminated light emission devices; a power source connected to and providing power to the array of light emission devices and to the logic circuit; and at least one input device connected to the logic circuit and operable to adjust the arrangement of illuminated light emission devices.

Another aspect is a light emitting head accessory. The light emitting head accessory includes a strip of flexible material having a front surface; a first array of light emission devices positioned on the front surface, wherein the array includes a plurality of rows and columns of the light emission devices; a plurality of strands of material attached to the strip of flexible material, wherein the strands are positioned to hang downward below the strip of flexible material; a second array of light emission devices attached to the plurality of strands of material; a logic circuit electrically coupled to the first array of light emission devices and to the second array of light emission devices and programmed to illuminate a first plurality of light emission devices in the first array of light emission devices and a second plurality of light emission devices in the second array of light emission devices, wherein the first plurality of illuminated light emission devices constitutes an arrangement selected from the group comprising text, images, animations, videos, and characters; a power source connected to and providing power to the first array of light emission devices, the second array of light emission devices, and the logic circuit; at least one input device connected to the logic circuit, wherein the at least one input device controls the arrangements displayed on the array of light emission devices; a first fastening device positioned on a first end of the strip of flexible material; and a second fastening device positioned on a second end of the strip of flexible material opposite the first end, wherein the first fastening device is configured to fasten with the second fastening device to arrange the strip of flexible material into a closed loop.

Yet another aspect is a method of displaying a graphical arrangement on a light emitting head accessory. The method includes arranging a light emitting head accessory on a head of a person, the light emitting head accessory including a flexible strip of material forming a closed loop around the head; receiving an input with an input device from a user; determining with a logic circuit device a first graphical arrangement to be displayed; and displaying the first graphical arrangement with an array of light emission devices, the light emission devices being electrically coupled to the logic circuit and positioned on a front surface of the strip of flexible material.

There is no requirement that an arrangement, system, or method described herein include all features characterized herein to obtain some advantage according to this disclosure.

DETAILED DESCRIPTION OF THE PREFERRED EMBODIMENT

Figure 1:
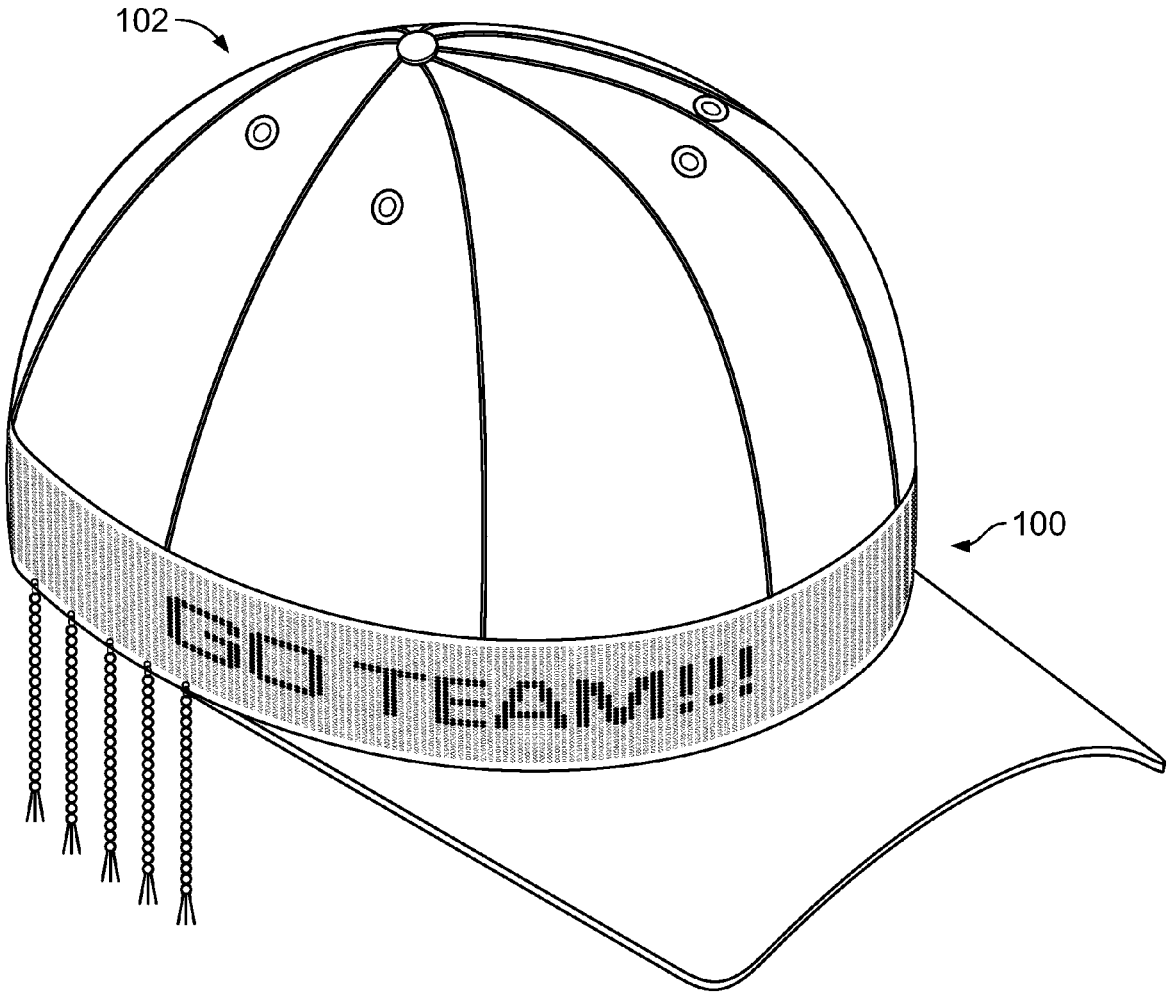
FIG. 1 is a perspective view of an example light emitting head accessory attached to an athletic cap according to the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 illustrates an example light emitting head accessory 100 attached to an athletic cap 102 according to the present disclosure. In example embodiments, light emitting head accessory 100 can be removed from athletic cap 102. In other embodiments, light emitting head accessory 100 is permanently attached to athletic cap 102.

As described in more detail below, light emitting head accessory 100 includes an array of light emission devices. The array is controlled by a processor to selectively illuminate some of the light emission devices in a desired pattern or arrangement. For example, a message can be displayed on the array, such as "GO TEAM!!!," as shown in FIG. 1. The light emitting head accessory 100 is typically arranged around a forehead of a person (either directly or on another article, such as a hat). If worn by a spectator at a sporting event, for example, the arrangement does not substantially obstruct the view of other spectators.

Figure 2:
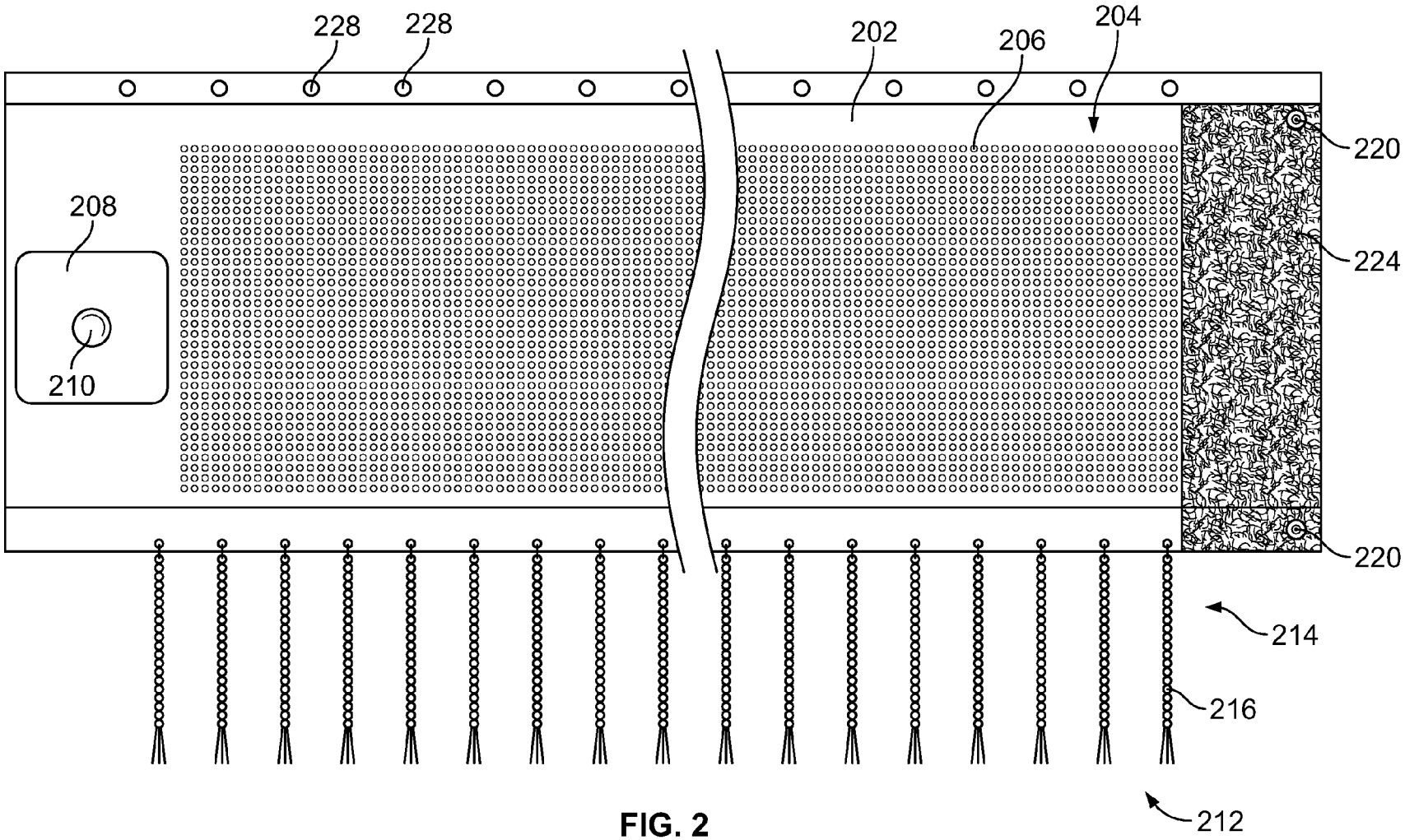
FIG. 2 is a schematic diagram of the front surface of the example light emitting head accessory of FIG. 1.
Figure 3:
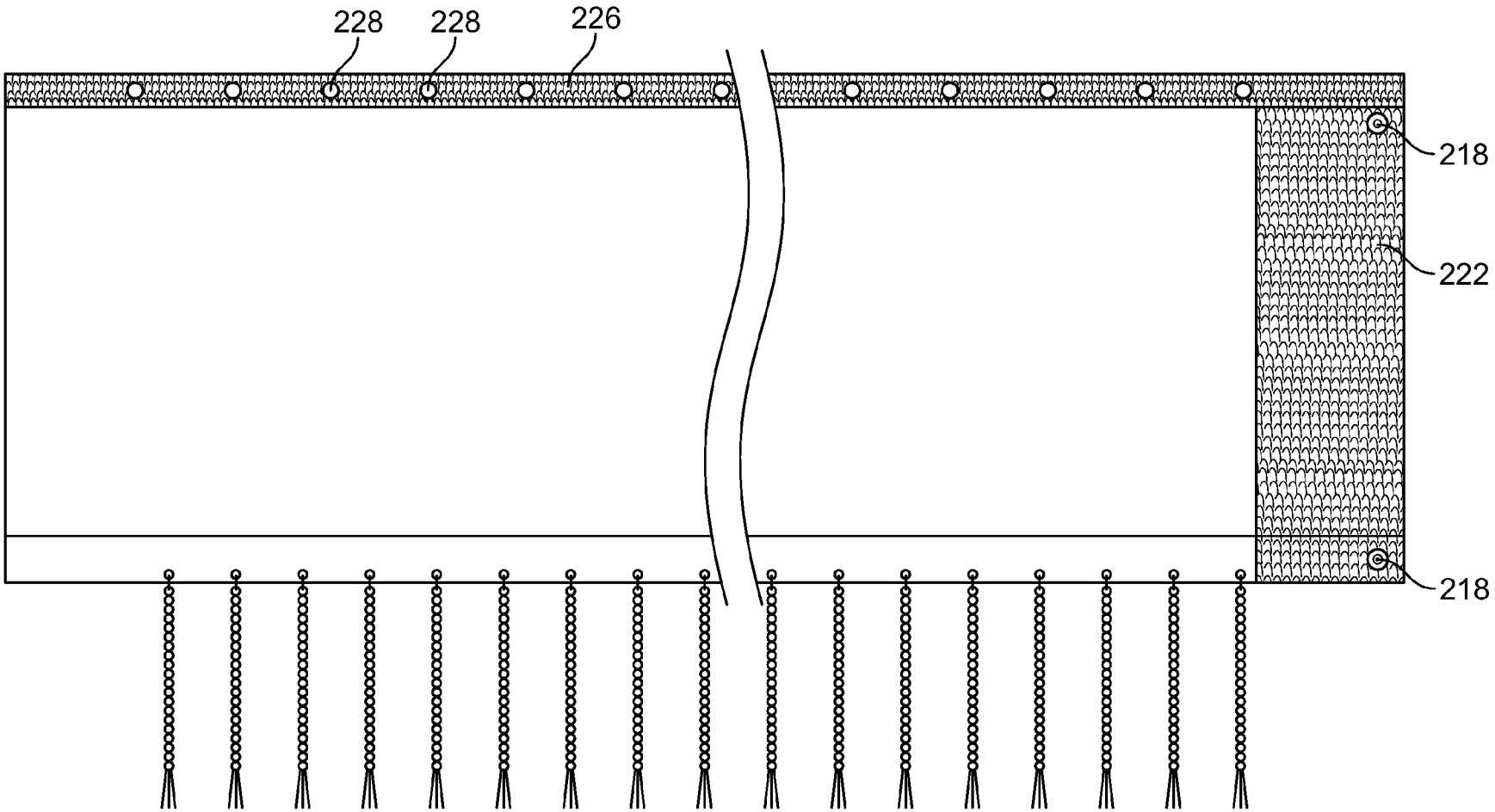
FIG. 3 is a schematic diagram of the back surface of the example light emitting head accessory of FIG. 1.

FIG. 2-3 show the structure of the example light emitting head accessory 100 in further detail. FIG. 2 is a schematic diagram of the front surface of example light emitting head accessory 100. FIG. 3 is a schematic diagram of the back surface of example light emitting head accessory 100.

Looking to FIG. 2, the light emitting head accessory 100 includes a strip of flexible material 202. In some embodiments, the strip of flexible material 202 runs the entire length of the light emitting head accessory 100 and is sized to fit around a persons head. In some embodiments, the light emitting head accessory 100 has a length in a range from about 10 inches to about 50 inches, and preferably in a range from about 20 inches to about 30 inches. In some embodiments, the light emitting head accessory 100 has a height in a range from about a half an inch to about 6 inches, and preferably from about 1 inch to about 4 inches. In other embodiments, the length and height is greater or smaller than these ranges. In some embodiments flexible material 202 includes multiple layers of materials or multiple types of materials. Examples of flexible materials include fabric, elastic, rubber, cardboard, paper, plastic, a flexible circuit board, or other flexible materials or combinations thereof. The flexible material allows the light emitting head accessory 100 to confirm to the size and shape of a person's head or a hat in some embodiments. In yet other embodiments, a strip of material is used that is substantially rigid, such as made out of a substantially rigid plastic.

The strip of flexible material 202 has a forward facing surface on which an array of light emission devices 204 are positioned. In some embodiments the array of light emission devices is arranged directly on the strip of flexible material. In other embodiments, the array of light emission devices is arranged on another material that is supported by the strip of flexible material 202. The array of light emission devices 204 contains an array (or matrix) of individual light emission devices 206. In example embodiments, the array of light emission devices 204 is a plurality of light emitting diodes ("LEDs"). In such an example, the individual light emission devices 206 are individual LEDs. In other embodiments, the array of light emission devices 204 is a liquid crystal display ("LCD") panel, a plurality of light bulbs (such as incandescent, halogen, florescent, etc.), an organic light emitting diode ("OLED") panel, an electroluminescent display ("ELD"), or an electronic paper ("e-paper") display. Other embodiments include other light emission devices. A light emission device includes devices that selectively reflect light, but do not actually generate light. In some of these examples, the individual light emission devices 206 are individual pixels on the display.

Because the array of light emission devices are connected to a strip of flexible material 202, the array of light emission devices is also flexible in some embodiments. In some embodiments the array of light emission devices forms a loop (e.g., circular or elliptical when viewed from the top) so as to surround or substantially surround the head. In some embodiments a length of the array is in a range from about 50% to about 100% of the length of the strip of flexible material 102, and preferably in a range from about 75% to about 95% of the length of the strip of flexible material 102. In this way, a pattern or arrangement of illuminated light emission devices can be presented around most, or all, of the light emitting head accessory 100. For example, the pattern or arrangement can be displayed on the front and sides of the light emitting head accessory 100, and on or near the back of the light emitting head accessory 100 in some embodiments.

In example embodiments, such as the one shown in FIG. 2, the array of light emission devices 204 includes a plurality of rows and columns of individual light emission devices 204. In one example, the array of light emission devices 204 has a quantity of columns in a range from about 20 to about 50. In other embodiments, the quantity of columns is in the range from about 50 to about 2000 (or more, such as 3000, 4000, 10000, etc). Other embodiments include greater or fewer columns. The quantity of columns is dictated in part by the length of the array of light emission devices 204 used on the light emitting head accessory 100 and the size of the individual light emission devices.

In one example, the array of light emission devices 204 has a quantity of rows in a range from about 5 to about 11. In other embodiments, the quantity of rows is in the range from about 12 to about 500. Other embodiments include greater or fewer rows. The quantity of rows is dictated in part by the height of the array of light emission devices 204 used on the light emitting head accessory 100 and the size of the individual light emission devices. The quantity of columns and rows is also dictated by the display technology used for the array of light emission devices 204. In some embodiments utilizing higher resolution panels, such as LCD or OLED, there are hundreds of rows and columns of individual light emission devices 206. There is no inherent limit in how many rows and columns could be used. Considerations are increased cost and size of the array of light emission devices 204 as more rows and columns are added. In addition, the level of resolution desired is a consideration. If a high level of resolution is desired, there should be a greater amount of rows and columns of individual light emission devices 206 and the rows and columns should be spaced closer together.

Depending on the type of display used, the array of light emission devices 204 is capable of one color display, multi color display, or full color display. For example, in examples where the light emitting head accessory 100 includes an LCD, OLED, or multi-color LED video panel as the array of light emission devices 204, full color text, images, and video may be displayed. In other embodiments, implementing less expensive single color LED arrays as the array of light emission devices 204, only single colors of text, images, and video are displayed. In addition, less complex and less expensive versions of the light emitting head accessory 100 operate to display static and/or scrolling text or simple animations.

The light emitting head accessory 100 also includes an electronics enclosure 208 in some embodiments. In example embodiments, the electronics enclosure 208 contains a logic circuit, and a power source. A data communication device is also included in some embodiments. These devices will be discussed in further detail with regard to FIG. 4. In example embodiments, the electronics enclosure 208 includes an input device 210, for user interaction and control of the light emitting head accessory 100. In example embodiments, the light emitting head accessory 100 includes at least one input device 210 connected to the logic circuit. The input device 210 controls the arrangements displayed on the array of light emission devices 204. In example embodiments, the input device 210 is a button that can be pressed to cycle through displaying a series of different arrangements on the array of light emission devices 204. In other embodiments, the input device 210 is a switch, dial, keypad, or other appropriate input device. Some embodiments of input device 210 include a wireless receiver (or transceiver), for receiving a data signal via a infrared, radio frequency, or other communication device. In some embodiments, there is more than one input device 210. In example embodiments, the input device is used to turn the power on and off to the light emitting head accessory 100. In other embodiments, the input may be configured to only turn the power on or off to the light emitting head accessory 100.

In some embodiments, the light emitting head accessory 100 also includes a plurality of strands 212 attached to the strip of flexible material 202. The strands 212 are positioned to hang downward below the strip of flexible material 202. The strands 212 incorporate a second array of light emission devices 214. Similar to the array of light emission devices 204, the second array of light emission devices 214 contains an array (or matrix) of individual light emission devices 216. In example embodiments, there are between about 10-30 strands 212 going around the entire circumference of the light emitting head accessory 100. In other embodiments there are greater or fewer strands. In example embodiments, each strand has between about 1-20 individual light emission devices 216. In other embodiments there are greater or fewer amounts of individual light emission devices 216 on each strand or none at all.

Looking to the example embodiment shown in FIGS. 2-3, the light emitting head accessory 100 includes first fastening devices 218 positioned on a back side of a first end of the strip of flexible material 202 and second fastening devices 220 positioned on the front side of a second end of the strip of flexible material 202, opposite the first end. The first fastening devices 218 are configured to fasten with the second fastening devices 220, such that the light emitting head accessory 100 can be placed on a person's head or a hat and be connected together into a closed loop around the person's head or hat. In example embodiments, the first fastening devices 218 are the closure elements of snap buttons and the second fastening devices 220 are attaching elements of snap buttons. The closure elements of first fastening devices 218 are configured to snap together with the attaching elements of second fastening devices 220. The example light emitting head accessory 100 shown in FIGS. 2-3 includes two closure elements for the first fastening devices 218 which are configured to snap with the two attaching elements for the second fastening devices 220.

In example embodiments, the light emitting head accessory 100 also includes a third fastening device 222 positioned on the back side of the first end of the flexible material 202 and a fourth fastening device 224 positioned on the front side of the second end of the flexible material 202. The third fastening device 222 is designed to fasten together with the fourth fastening device 224. In example embodiments, the third fastening device 222 is a hook fastener and the fourth fastening device 224 is a loop fastener. The hook fastener of the third fastening device 222 is configured to fasten to the loop fastener of the fourth fastening device 224. In example embodiments, the hook fastener of the third fastening device 222 and the loop fastener of the fourth fastening device 224 are a hook and loop fastening system, such as the VELCRO® brand hook-and-loop fasteners manufactured by Velcro Industries V.B. It is contemplated that other fastening mechanisms can be used for the first fastening devices 218, the second fastening devices 220, the third fastening device 222, or the fourth fastening device 224, such as clips, buttons, buttonholes, eyelets, grommets, pins, zippers, clamps, rivets, and other suitable fastening devices. In addition, it is also contemplated that example embodiments could include greater or fewer fastening devices designed to connect the two ends of the light emitting head accessory 100 together around one's head.

Other embodiments of light emitting head accessory 100 do not include the fastening devices described above because they use a closed loop of flexible material, wherein the strip of flexible material 202 is permanently fastened together at the back ends (e.g., by sewing). In embodiments with the closed loop, a size adjustment mechanism allows for adjusting the size of the light emitting head accessory 100. In some embodiments, the strip of flexible material 202 is or includes elastic, so that the light emitting head accessory 100 will better stay on a persons head or headwear. In other embodiments, a sizing mechanism is used to size the light emitting head accessory 100, similar to those used on athletic caps and other hats. These additional functions are used in example embodiments utilizing both the closed loop and open loop strip of flexible material 202 described above.

In some embodiments, the light emitting head accessory 100 includes a fifth fastening device 226 attached to, or part of, the strip of flexible material 202. In some embodiments, the fifth fastening device 226 is configured to attach the light emitting head accessory 100 to another piece of headwear, such as a headband, an athletic cap, a beanie, or another hat. An example of the fifth fastening device 226 is the hook component of a hook-and-loop fastening system, such as VELCRO® brand hook-and-loop fastening systems. In some embodiments, the light emitting head accessory 100 includes a sixth fastening device 228 attached to, or part of, the strip of flexible material 202. In some embodiments, the sixth fastening device 228 is configured to attach the light emitting head accessory 100 to another piece of headwear. An example of the sixth fastening device 228 includes one or more grommet hole for connecting the light emitting head accessory 100 to a beanie or other hat. In other embodiments, a variety of other fasteners can be used as the fifth fastening device 226 or the sixth fastening device 228, such as clips, buttons, buttonholes, eyelets, grommets, pins, zippers, clamps, rivets, and other suitable fastening devices.

In example embodiments, the light emitting head accessory 100 is colored to match an athletic cap having a teams logo and colors. Specifically, the strip of flexible material 202, the electronics enclosure 208, and other prominent elements of the light emitting head accessory 100 are colored to match a particular athletic team's colors. In addition in example embodiments, the array of light emission devices 204 and second array of light emission devices 214 are colored to match the particular athletic team's colors.

Figure 4:
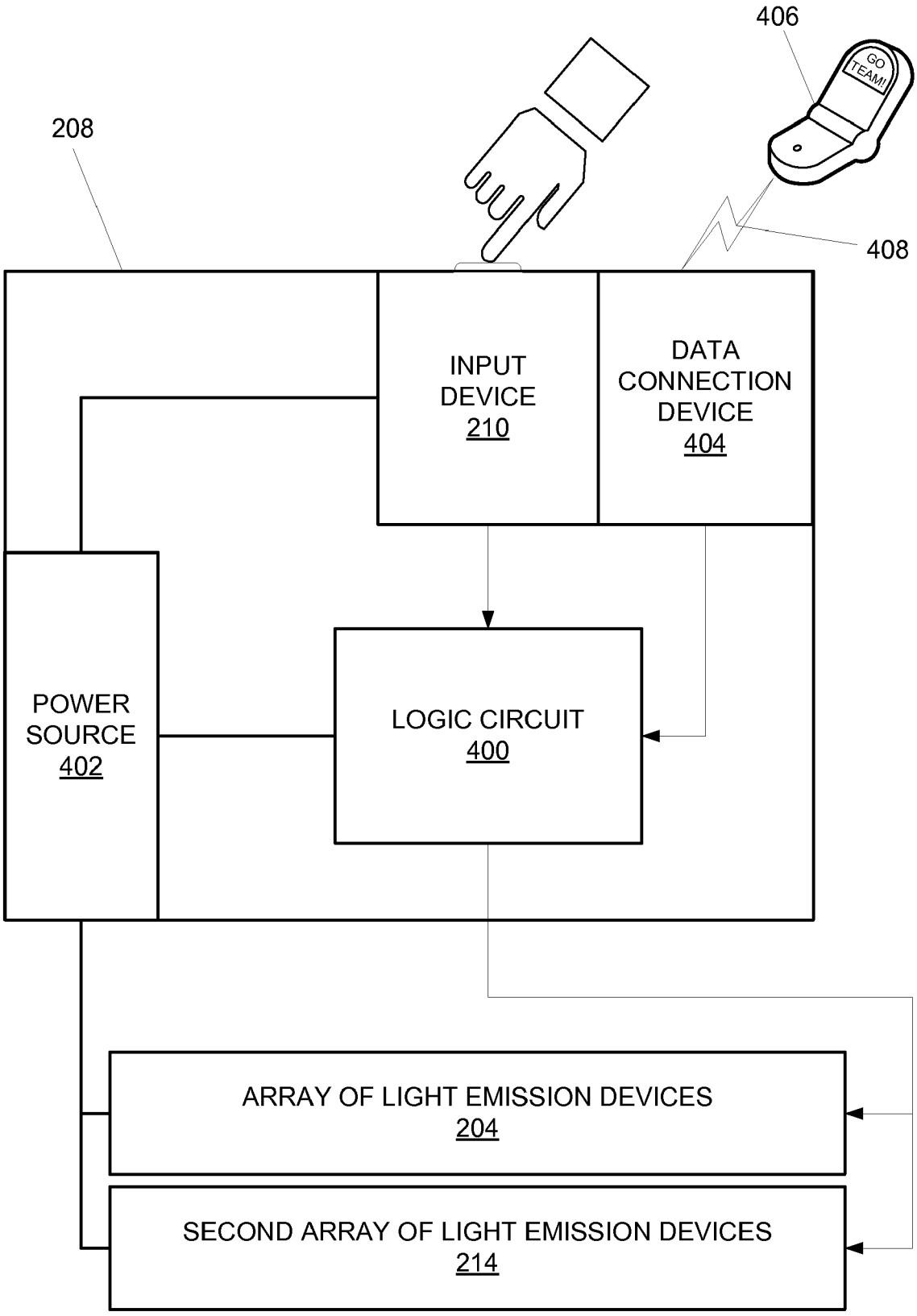
FIG. 4 is a schematic block diagram of example electrical components of the example light emitting head accessory of FIG. 1.

FIG. 4 is a schematic block diagram of the components included in the electronics enclosure 208, illustrating how those components interface with other elements of the light emitting head accessory 100. In example embodiments, the electronics enclosure 208 includes a logic circuit 400 and a power source 402, in addition to the input device 210 discussed above. In example embodiments, the logic circuit 400 includes a processor and memory and is able to process data instructions. In example embodiments, the logic circuit 400 is connected to the array of light emission devices 204 and programmed to illuminate a subset of the array of light emission devices 204. Specifically, the logic circuit 400 controls the array of light emission devices 204 to display arrangements by illuminating a plurality of the individual light emission devices 206. In example embodiments, the input device 210 is used to select and toggle between various arrangements of lights on the array of light emission devices 204. As is shown in further detail in FIGS. 6-11 and described in the accompanying description, the arrangements can include text, images, animations, videos, and other characters. In example embodiments, logic circuit 400 might instruct the array of light emission devices 204 to blink on and off continuously, to scroll a message, to display a static image, to display an animated image, to display a video, or to display combinations of text, images, and video.

The logic circuit 400 also controls the illumination of the second array of light emission devices 214. In example embodiments, the input device 210 is used to select and toggle between various arrangements of lights on the second array of light emission devices 214. In some embodiments, logic circuit 400 instructs the second array of light emission devices 214 to blink on and off continuously, to scroll a message, to display a static image, to display an animated image, to display a video, or to display combinations of text, images, and video.

In example embodiments of light emitting head accessory 100, the power source 402 powers the array of light emission devices 204 and the logic circuit 400. In example embodiments, the power source is a battery back using standard consumer grade batteries, such as AA, AAA, C, D, 9-Volt, or button batteries. In example embodiments, the batteries are Alkaline, NiCAD, NiMH, or Lithium type. In example embodiments, the batteries are either one time use or rechargeable.

In example embodiments, the electronics enclosure 208 also contains a data connection device 404. In other embodiments, the data connection device 404 is positioned at a different location. Other embodiments of light emitting head accessory 100 do not include a data connection device 404. In embodiments including the data connection device 404, the power source 402 supplies power to the data connection device 404. In example embodiments, the data connection device 404 receives data and instructions from an external device 406 through a data connection 408 and relays it to the logic circuit 400. Examples of external devices include a mobile telephone, a handheld computer, a smart phone, a portable digital assistant, a cellular telephone network, a satellite, and a remote control device. In example embodiments, the data connection device is configured for wireless connection to the external device 406 through a wired data connection 408. In other embodiments, the data connection device is configured for wired connection to the external device 406 through a wired data connection 408. The logic circuit 400 then uses the data and instructions to display different arrangements on the array of light emission devices 204 and the second array of light emission devices 214.

The input device 210 is positioned to be readily accessible by the person operating the light emitting head accessory 100. The input device 210 can be used to toggle between different display configurations and modes. For example, an example embodiment includes a first configuration where a first alphanumeric message is displayed on the array of light emission devices 204, while the second array of light emission devices 214 is turned on and off repeatedly. A second configuration displays an animation on the array of light emission devices 204, while displaying a pattern on the second array of light emission devices 214. In addition, a third configuration activates the data connection 408 between the data connection device 404 and the external device 406 and accepts instructions from the external device 406. There is no inherent restriction on how many different configurations can be toggled with the input device 210, nor is there any inherent restriction on how many different arrangements can be displayed on the array of light emission devices 204 and the second array of light emission devices 214 of the light emitting head accessory 100. In some embodiments, limitations will be imposed based on the amount of memory or the size and resolution of the array of light emission devices 204 and the second array of light emission devices 214. Several arrangements will be discussed in detail with regards to FIGS. 6-11. In addition, an implementation utilizing a data connection 408 between an external device 406 and the data connection device 404 of the light emitting head accessory 100 will be discussed with regard to FIGS. 12-13.

Figure 5:
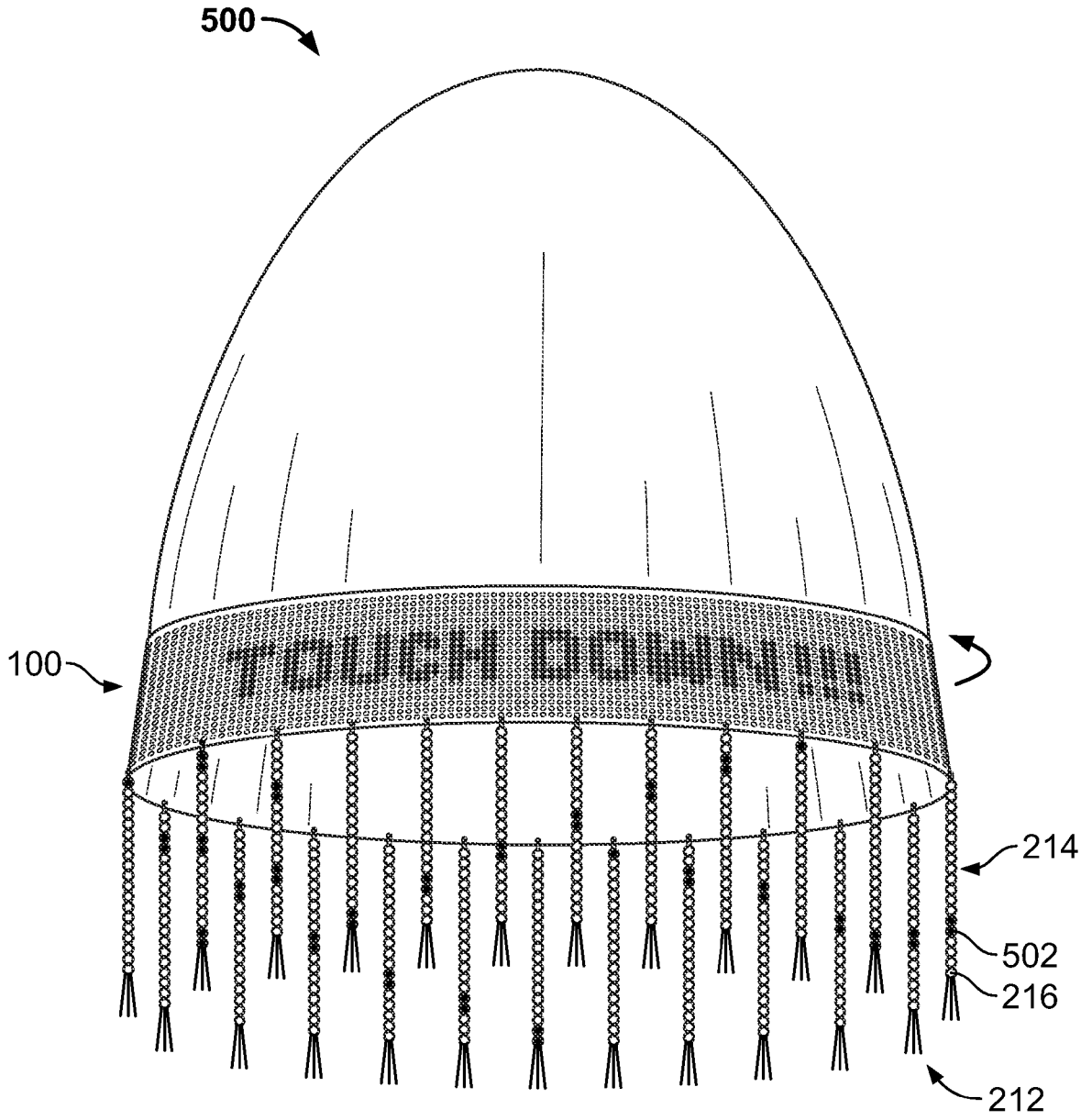
FIG. 5 is a perspective view of the example light emitting head accessory of FIG. 1 attached to a beanie cap.

FIG. 5 is a perspective view of the example light emitting head accessory 100 attached to a beanie cap 500. In this embodiment, the sixth fastening device 228 (shown in FIG. 2) includes grommet holes and the light emitting head accessory 100 is attached to the beanie cap 500 at the sixth fastening device 228 by string, yarn, or other binding (not shown in FIG. 5). In example embodiments, such as the one shown in FIG. 5, the second array of light emission devices 214 displays a dynamic pattern by illuminating selected individual light emission devices 216. In FIG. 5, illuminated light emitting device 502 is illuminated along with other individual light emission devices 216 to display an increasing and repeating diagonal pattern, simulating "the wave" performed by spectators at sporting events. As noted above, the colors and team logos on the beanie cap 500 can be coordinated with the colors of the light emitting head accessory 100, including the array of light emission devices 204 and the second array of light emission devices 214.

FIGS. 6-11 show example displays of the light emitting head accessory 100 where the array of light emission devices 204 is setup in various different arrangements. As described earlier, the arrangements can include text, images, animations, videos, and other characters. In some embodiments, logic circuit 400 instructs the array of light emission devices 204 to blink on and off continuously, to scroll a message, to display a static image, to display an animated image, to display a video, to display combinations of text, images, and video, or a variety of alternative arrangements.

Figure 6:
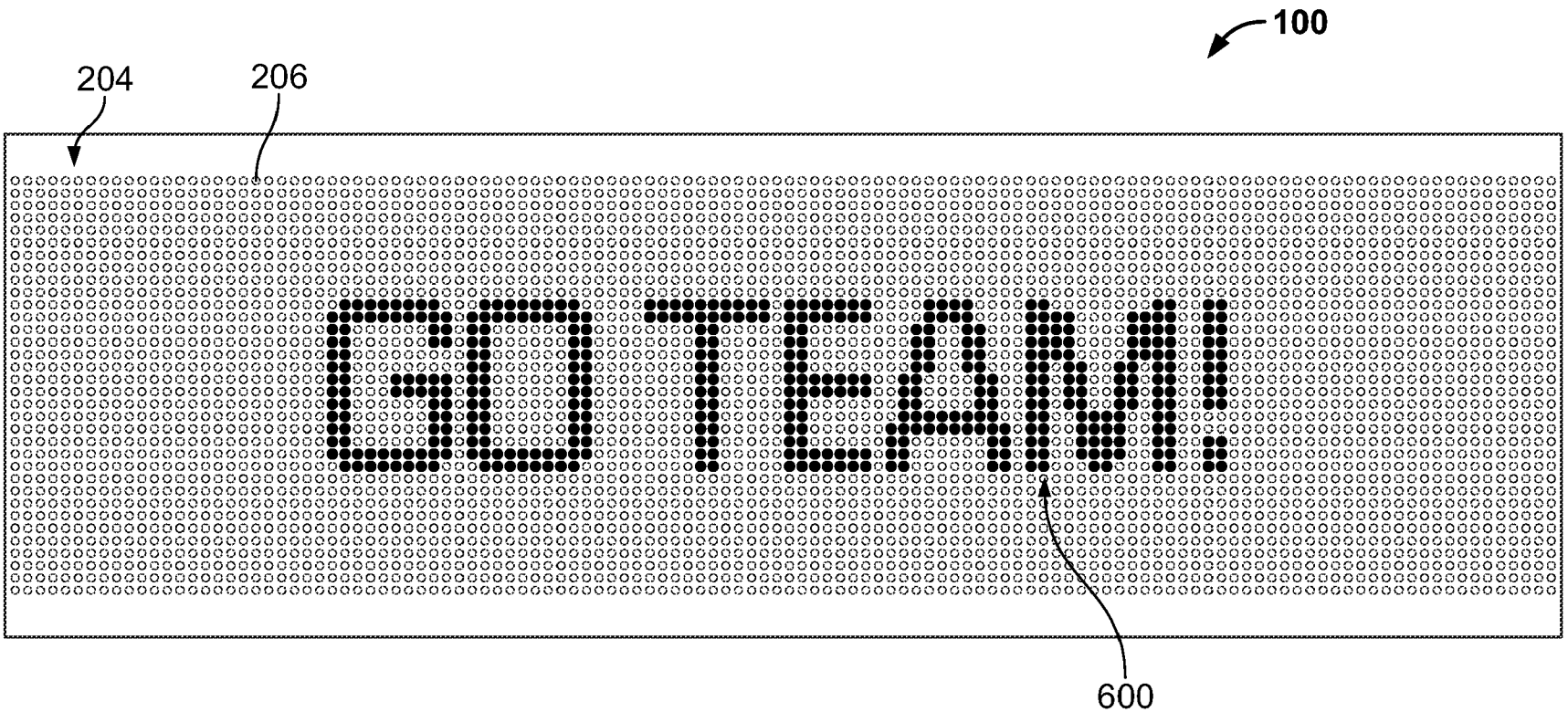
FIG. 6 is an example display of the example light emitting head accessory of FIG. 1 while displaying an alphanumeric message.

FIG. 6 is an example display of the light emitting head accessory 100 while displaying an alphanumeric message 600. Specifically, in the example display shown in FIG. 6, the message "GO TEAM!" is displayed by illuminating specific individual light emission devices 206 in the array of light emission devices 204. In some embodiments, this alphanumeric message 600 is static. In other embodiments, the arrangement is caused to scroll across the array of light emission devices 204, from one side of the light emitting head accessory 100 to another. In other embodiments, the alphanumeric message 600 dynamically changes in shape, size, orientation, or color.

Figure 7:
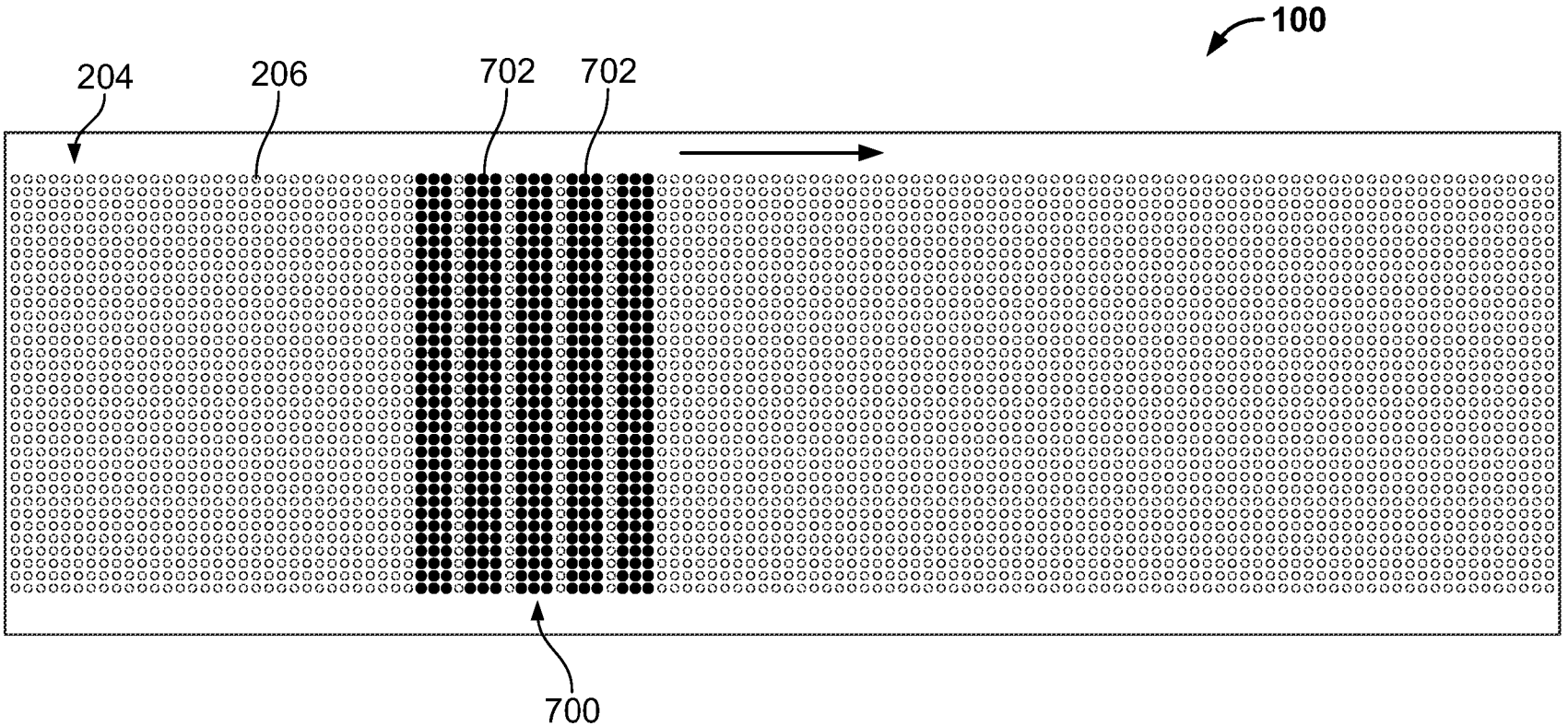
FIG. 7 is an example display of the example light emitting head accessory of FIG. 1 while displaying a scrolling image.

FIG. 7 is an example display of the light emitting head accessory 100 while displaying a scrolling image 700. Specifically, in the example display shown in FIG. 5, a plurality of adjacent columns 702 are illuminated at the left edge of the array of light emission devices and move quickly across the array of light emission devices 204 from left to right. In addition, once the adjacent columns 702 reach the right edge of the array of light emission devices 204, the adjacent columns 702 wrap around to the left edge of the array of light emission devices 204 and again move from left to right across the array of light emission devices 204. This process repeats continuously, simulating the flashing lights on an emergency vehicle. In other embodiments, the adjacent columns 702 "bounce" off the left edge and the right edge of the array of light emission devices 204. It is also contemplated that other effects could be added to the scrolling image 700, such as varying brightness and intensity of the adjacent columns 702 and varying the speed at which the adjacent columns 702 travel across the array of light emission devices 204.

Figure 8:
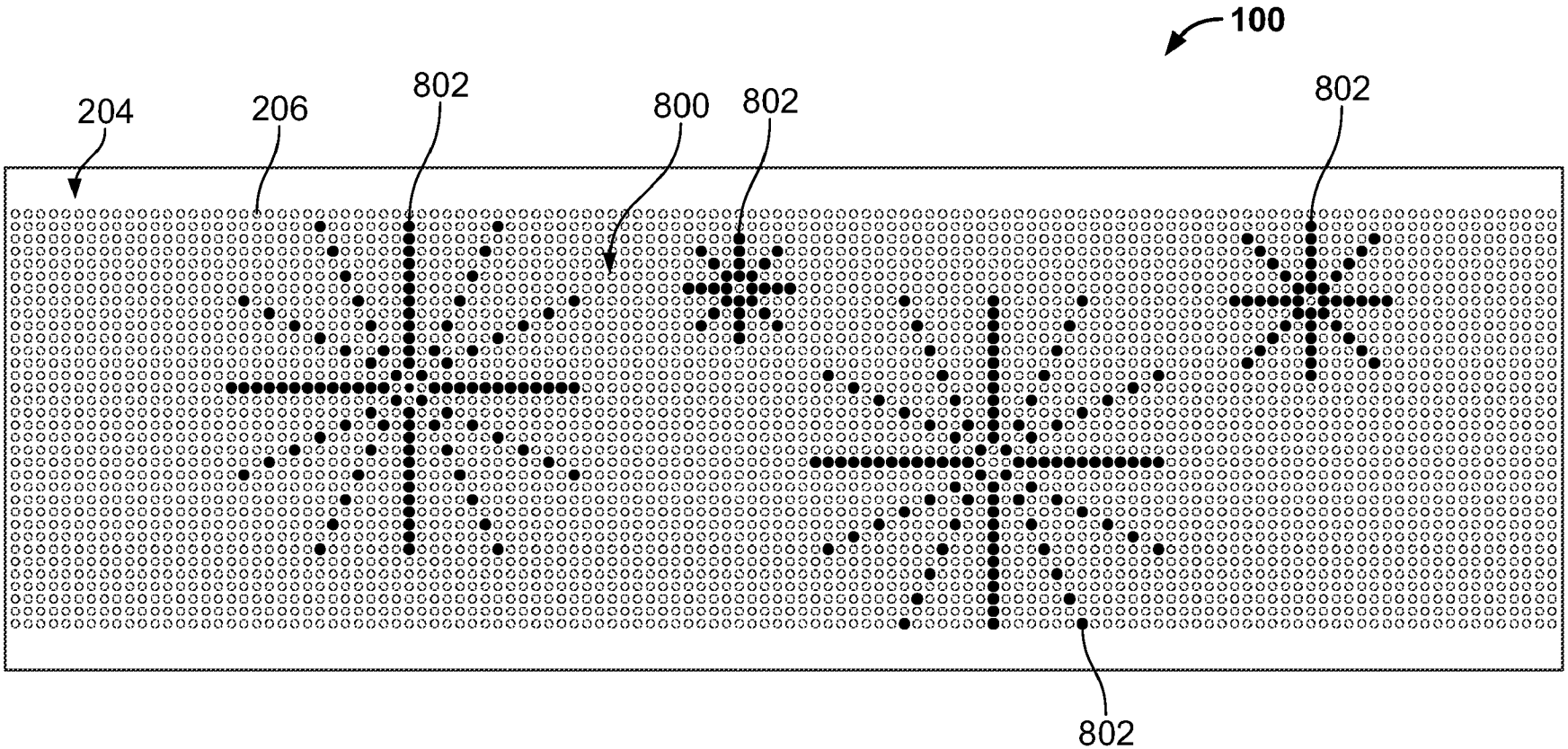
FIG. 8 is an example display of the example light emitting head accessory of FIG. 1 while displaying an animated image.

FIG. 8 is an example display of the light emitting head accessory 100 while displaying an animated image 800. Specifically, in the example display shown in FIG. 8, a plurality of animated fireworks 802 explode on the screen. In example embodiments, the animated fireworks 802 are various sizes and shapes. In example embodiments, the animated fireworks 802 are positioned at various spots on the array of light emission devices 204 and explode at different times and for different durations. In example embodiments having a multi color capable array of light emission devices 204, the animated fireworks 802 can be a range of different colors. It is also contemplated that other text, images, animations, and videos could be incorporated with the animated image 800.

Figure 9:
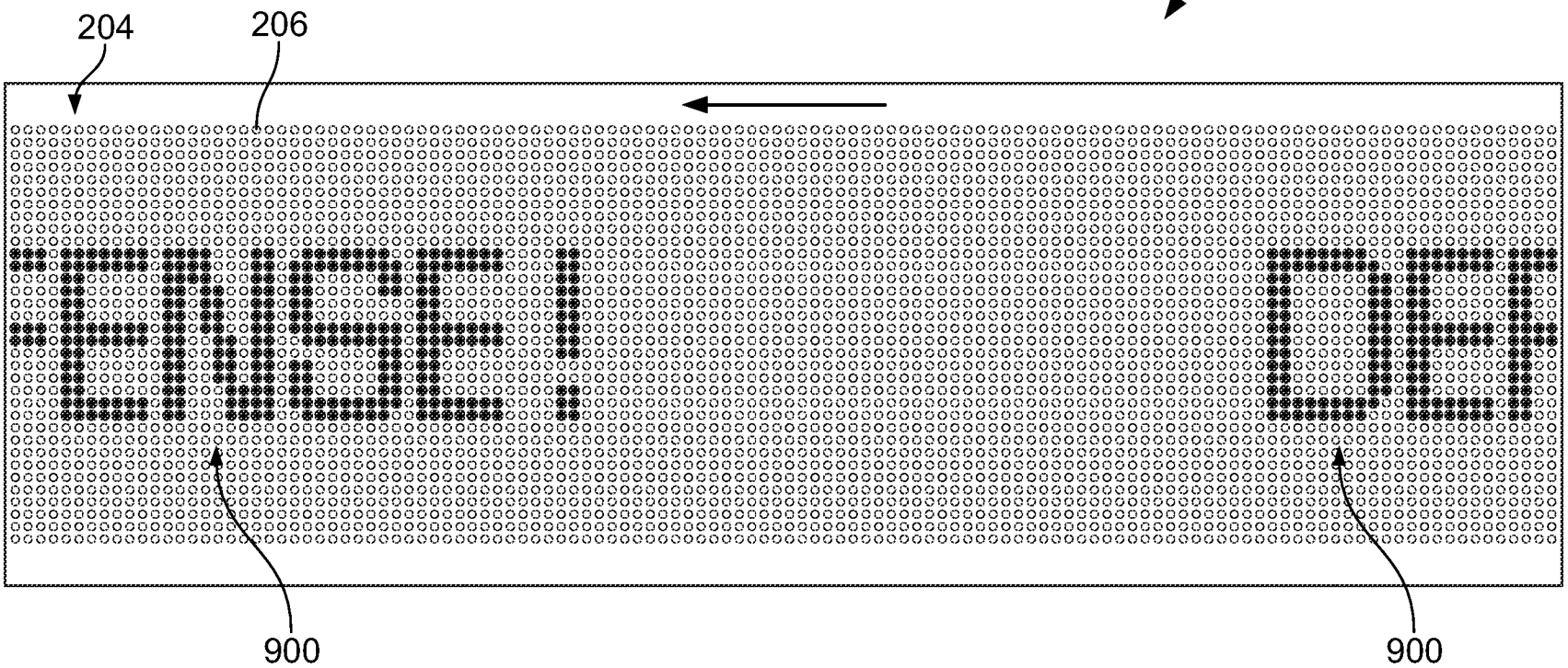
FIG. 9 is an example display of the example light emitting head accessory of FIG. 1 while displaying a scrolling and wrapping alphanumeric message.

FIG. 9 is an example display of the light emitting head accessory 100 while displaying a scrolling and wrapping alphanumeric message 900. Similar to the example display shown in FIG. 6, the characters "DEFENSE!" are displayed by illuminating specific individual light emission devices 206 in the array of light emission devices 204. In the embodiment show, alphanumeric message 900 is dynamically scrolling from right to left across the array of light emission devices 204. It is also contemplated that the alphanumeric message 900 could scroll in other directions, such as left to right, top to bottom, bottom to top, diagonally, or in any other direction. It is also contemplated that the alphanumeric message 900 can be enlarged and shrunken dynamically for added visual flair and appeal. As mentioned earlier and applicable to all possible displays according to the present invention, in other embodiments the alphanumeric message 900 dynamically changes in shape, size, orientation, or color.

Figure 10:
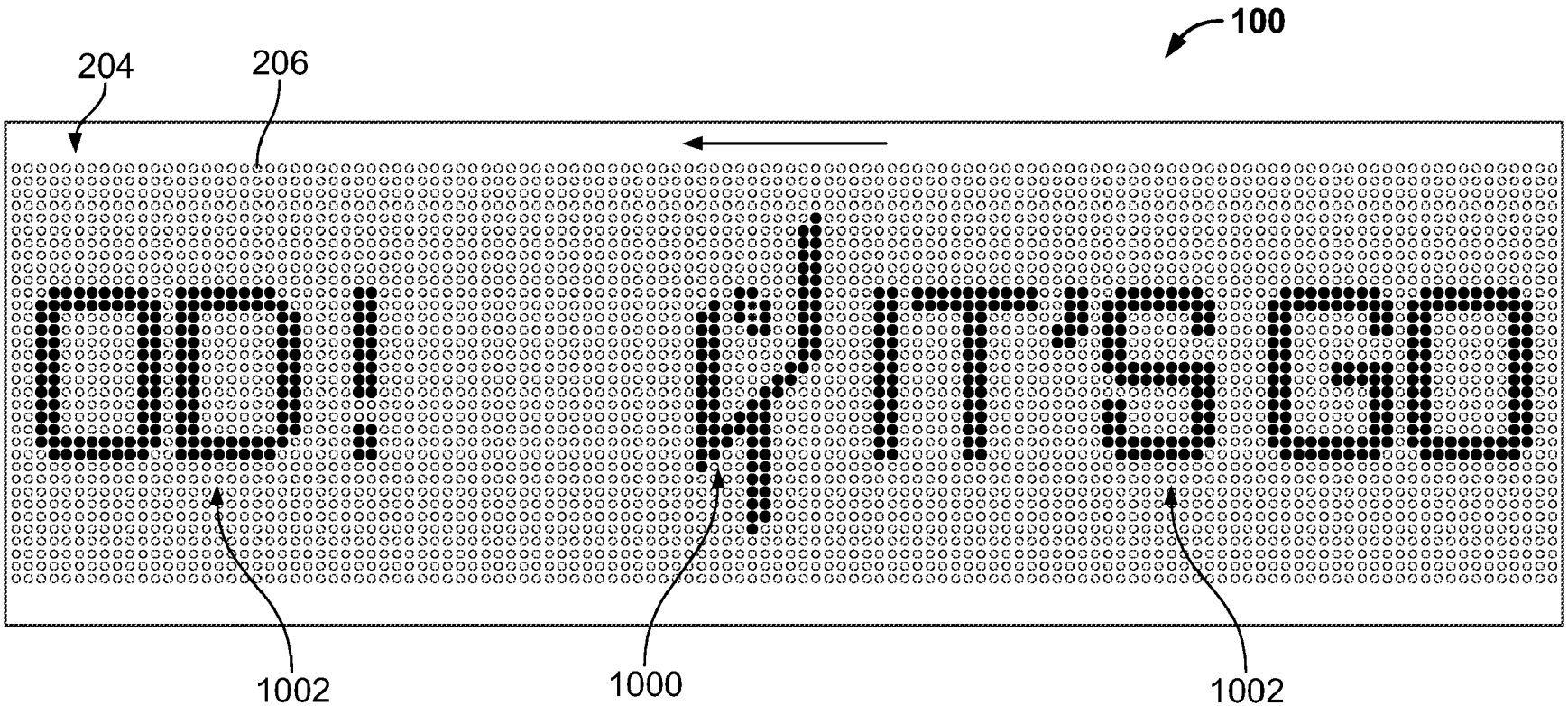
FIG. 10 is an example display of the example light emitting head accessory of FIG. 1 while displaying the combination of a scrolling image and alphanumeric message.

FIG. 10 is an example display of the light emitting head accessory 100 while displaying the combination of a scrolling image 1000 and text 1002. Specifically, in the example display shown in FIG. 10, a scrolling image 1000 of a football being kicked through an animated goalpost scrolls from right to left across the array of light emission devices 204. The scrolling image 1000 is followed by text 1002 indicating "IT'S GOOD!" In example embodiments, as the image 1000 and text 1002 scroll off the left side of the array of light emission devices 204, both the image 1000 and the text 1002 wrap around to the right side of the array of light emission devices 204. It is also contemplated that the image 1000 and text 1002 could scroll in other directions, such as left to right, top to bottom, bottom to top, diagonally, or in any other direction. It is also contemplated that the image 1000 and text 1002 can be enlarged and shrunken dynamically for added visual flair and appeal.

Figure 11:
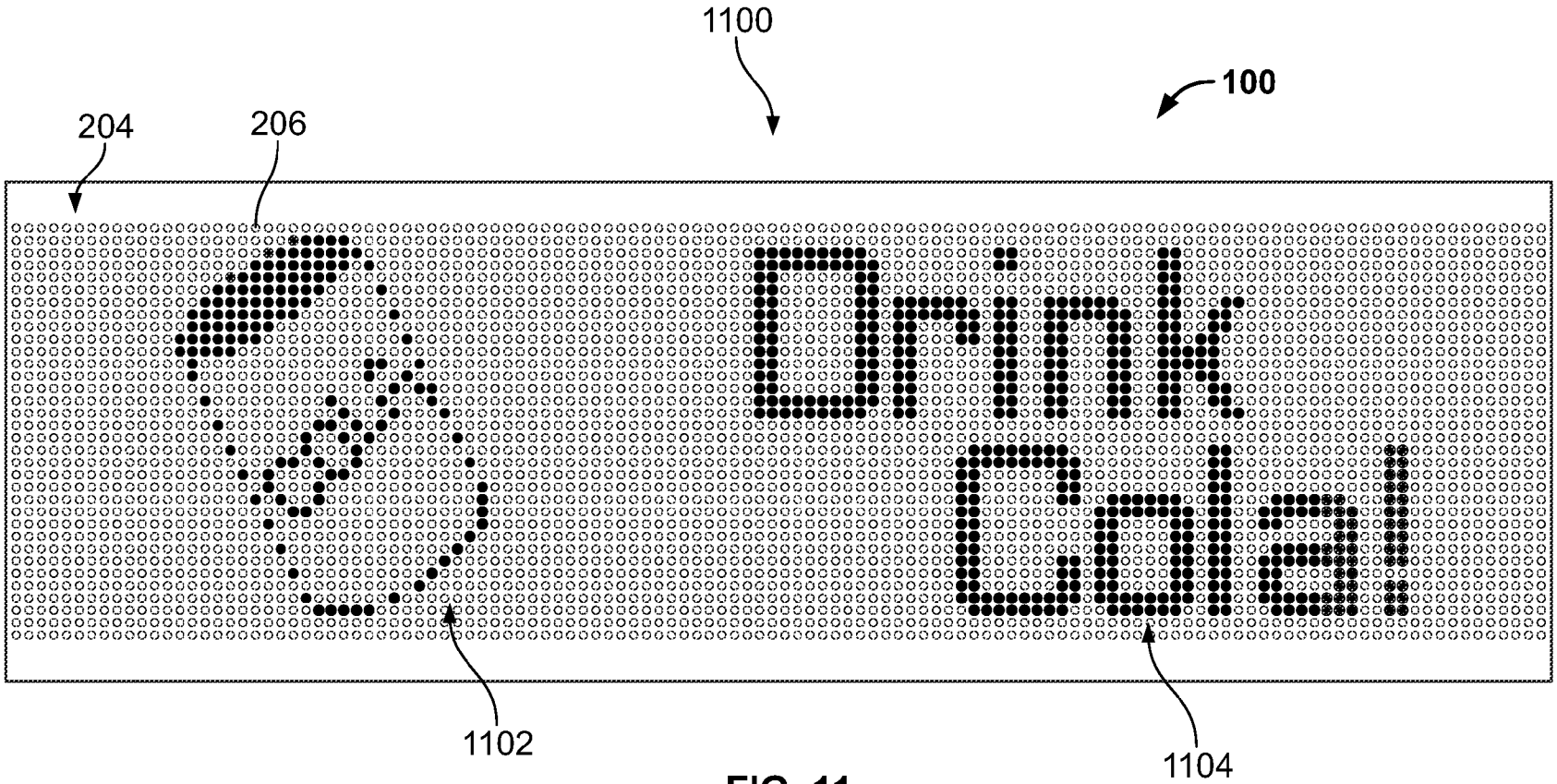
FIG. 11 is an example display of the example light emitting head accessory of FIG. 1 while displaying an advertisement including an image and an alphanumeric message.

FIG. 11 is an example display of the example light emitting head accessory 100 while displaying an advertisement 1100 including an image 1102 and an alphanumeric message 1104. Similar to the example display of FIG. 8, an image 1102 of a Cola can is on the left side of the array of light emission devices 204. In example embodiments, image 1102 of the Cola can is static. In other embodiments, image 1102 of the Cola can is dynamic. In addition, the alphanumeric message 1104 indicating "Drink Cola!" is displayed on the right side of the array of light emission devices 204. In example embodiments, alphanumeric message 1104 is dynamic. In other embodiments, alphanumeric message 1104 is static. In example embodiments having multi color capable hardware, the image 1102 and the alphanumeric message 1104 are displayed in multiple colors. As always, it is also contemplated that the image 1102 and alphanumeric message 1104 could scroll in various directions, such as right to left, left to right, top to bottom, bottom to top, diagonally, or in any other direction. It is also contemplated that the image 1102 and alphanumeric message 1104 can be enlarged and shrunken dynamically for added visual appeal.

In some embodiments, the advertisement 1100 is included with a light emitting head accessory 100 given away as a promotional item, such that the advertisement would automatically be displayed periodically for a specified amount of time. It is also contemplated that a light emitting head accessory 100 be worn by concessionaires at sporting events. In this example embodiment, the light emitting head accessory 100 displays the names and prices of the refreshments being sold by a concessionaire, making it easier for a spectator to determine what was available to purchase and how much it would cost. Specifically, the name and price of refreshments could scroll across the array of light emission devices 204. In example embodiments, other information such as an indication of the last call for alcohol or other promotions could be displayed on the light emitting head accessory 100 worn by the concessionaire. In example embodiments, scores and statistics from the current game as well as other games and events underway could be periodically displayed on the light emitting head accessory 100 as received wirelessly from an external device.

Figure 12:
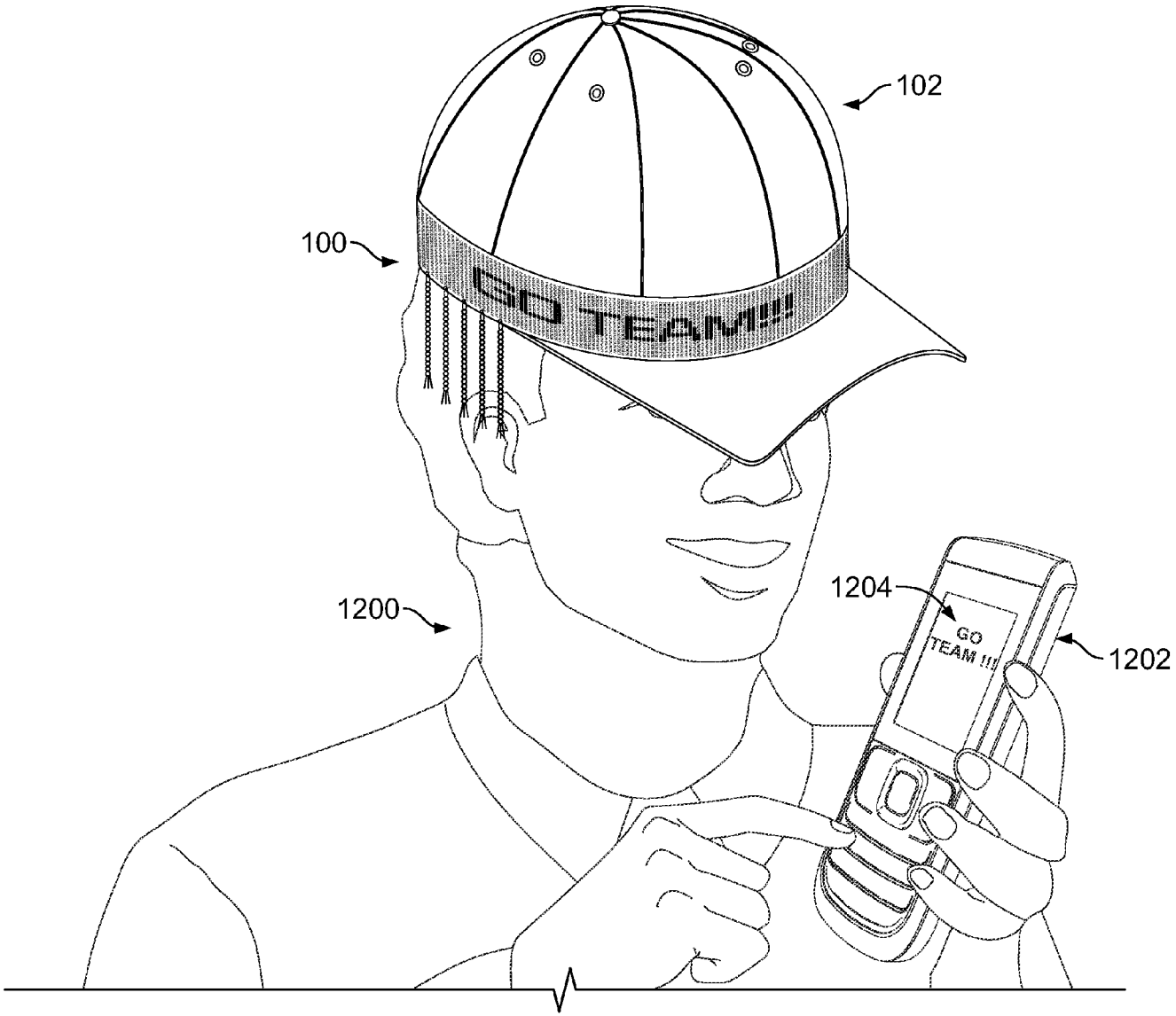
FIG. 12 is a perspective view of a person wearing the example light emitting head accessory of FIG. 1, while attached to an athletic cap and wirelessly connected to a mobile telephone, displaying an alphanumeric message as input into the mobile telephone by the person.

FIG. 12 is a perspective view of a person 1200 wearing the example light emitting head accessory 100, while attached to the athletic cap 102 and wirelessly connected to a mobile telephone 1202, displaying an alphanumeric message 1204 as input into the mobile telephone 1202 by the person 1200. In the example embodiment shown in FIG. 10, the example light emitting head accessory 100 includes the data connection device 404 connected to the logic circuit 400. In example embodiments, the data connection device 404 is a wireless communication device, such as a BLUETOOTH® adapter, a cellular network adapter, or other radio frequency enabled communication device. In other embodiments, the data connection device 404 is a wired communication device, such as a Universal Serial Bus ("USB") port. It is contemplated that other wireless or wired communication devices could be used for the data connection device 404.

In the embodiments employing a BLUETOOTH® adapter, an external device such as the mobile telephone 1202 is paired with the BLUETOOTH® adapter implementation of the data connection device 404 of the light emitting head accessory 100. In other embodiments employing a BLUETOOTH® adapter, a smart phone, personal digital assistant, netbook, or laptop with a BLUETOOTH® adapter could also be used in lieu of the mobile telephone 1202. In example embodiments, the person 1200 can determine what will be shown on the light emitting head accessory 100 by sending instructions from connected mobile telephone 1202. For example, the person 1200 could type the alphanumeric message 1204 "GO TEAM!" into his mobile telephone 1202 and send the instruction via the BLUETOOTH® connection to the light emitting head accessory 100. The light emitting head accessory 100 receives the instruction at the data connection device 404 implemented as a BLUETOOTH® adapter. The data connection device 404 relays the instruction to the logic circuit 400, which carries out the instruction by illuminating the appropriate individual light emission devices 206 in the array of light emission devices 204 to display "GO TEAM!" This same method can also be used by a person 1200 to send instructions to display other text, images, animations, videos, etc. It is even contemplated that the person 1200 would be able to take a picture on his mobile telephone 1202 and instantly send the picture via the BLUETOOTH® connection to the light emitting head accessory 100 to be displayed in real time. In other embodiments, a USB or other cable would be used to connect the mobile telephone 1202 to the light emitting head accessory 100. Once connected, the method of sending instructions and content to the light emitting head accessory 100 from the mobile telephone 1202 proceeds the same as outline above.

In some embodiments employing a cellular network adapter, the device receives instructions from the mobile telephone 1202 via a text message, such as a short message service ("SMS") message. Specifically, a spectator could compose a text message and send it to a number specific to the light emitting head accessory 100. The text message would contain instructions that could be implemented according to the method above. In other embodiments, the light emitting head accessory 100 is connected to a wireless network such that the light emitting head accessory 100 can be controlled remotely from another location at the game or even across a Wide Area Network ("WAN"), such as the Internet. In some embodiments an arrangement, pattern, or message is only displayed on light emitting head accessory 100 if a user has paid a subscription fee to a service provider.

In some embodiments a remote control device is used to control light emitting head accessory 100. An example of a remote control device is a cell phone configured to communicate with the light emitting head accessory. Another example of a remote control device is a key fob type device including one or more buttons. Each button is associated with a predetermined pattern or arrangement (which may include a message, graphic, text, animation, or combination thereof). When one of the buttons is selected (such as at the occurrence of an event), a signal is sent to the light emitting head accessory 100, which displays the associated pattern or arrangement. For example, upon the occurrence of a touchdown in a football game, the user selects a button associated with a touchdown arrangement. The remote control sends a signal to the light emitting head accessory 100, and the associated pattern or arrangement is displayed. In some embodiments the display continues until another button is pressed, or until the pattern or arrangement has completed, or until a predetermined time period has elapsed (e.g., a range from about 5 seconds to about 60 seconds).

Though the person 1200 was described in the previous examples as being both the person sending the instructions and wearing the light emitting head accessory 100, it is contemplated that in example embodiments other people or machines could remotely control the light emitting head accessory 100 via the wireless data connection 408. For example, a machine updates the light emitting head accessory 100 via the wireless data connection 408 in the example embodiment described above where a concessionaire is wearing the light emitting head accessory 100 and updated scores and statistics or other information are sent to the light emitting head accessory 100 in real time from a computing system automatically aggregating and sending the desired information.

In example embodiments, the communication between the mobile telephone 1202 and the light emitting head accessory 100 is bi-directional, such that the light emitting head accessory 100 sends information, such as status, back to the mobile telephone 1202.

Figure 13:
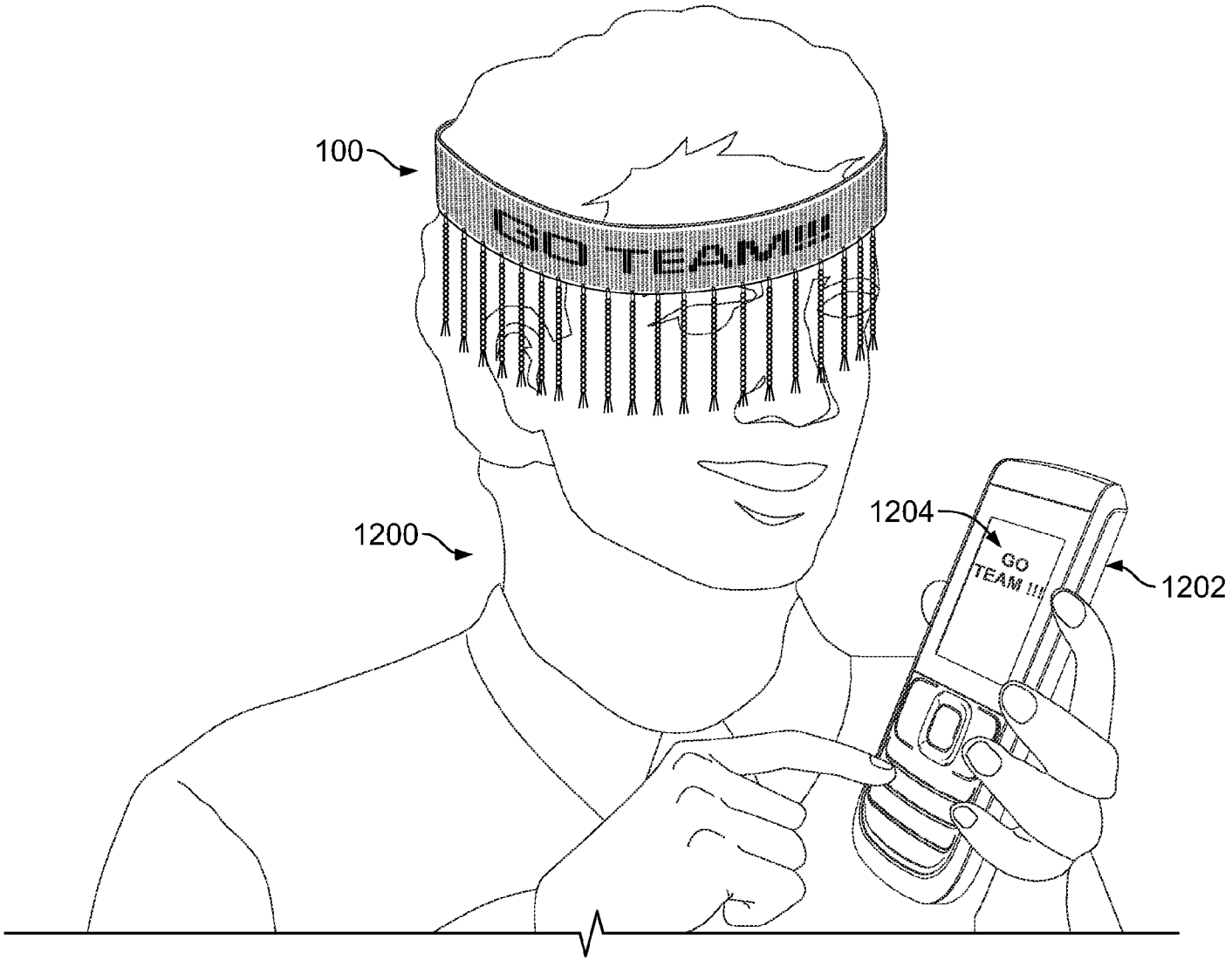
FIG. 13 is a perspective view of the example light emitting head accessory of FIG. 1, worn directly on a persons head and wirelessly connected to a mobile telephone, displaying an alphanumeric message as input into the mobile telephone by the person.

FIG. 13 is a perspective view of the light emitting head accessory 100 worn directly on the head of the person 1200. In example embodiments, the person 1200 wears the light emitting head accessory 100 directly on his head by placing the strip of flexible material 202 against the his forehead and connecting the first fastening devices 218 to the second fastening devices 220 at the back of his head. In example embodiments, the third fastening device 222 is also connected to the fourth fastening device 224. The plurality of strands 212 attached to the strip of flexible material 202 hang downward from the light emitting head accessory 100. The strands 212 incorporate the second array of light emission devices 214. In example embodiments, the strands 212 do not block the vision of the person 1200 because they are thin enough that the person 1200 can see around them. In other embodiments, the strands do not hang down from the entire circumference of the light emitting head accessory 100, such as to hang only on the sides and back of the person's head. This allows the user's face to be free of strands so that the person 1200 has a clear and unobstructed view.

The various embodiments described above are provided by way of illustration only and should not be construed to limit the claims attached hereto. Those skilled n the art will readily recognize various modifications and changes that may be made without following the example embodiments and applications illustrated and described herein, and without departing from the true spirit and scope of the following claims.

What is claimed is:

1. A light emitting head accessory comprising:

a strip of flexible material having a front surface, the strip sized to fit around a head of a person;

an array of light emission devices positioned on the front surface;

a logic circuit electrically coupled to the array of light emission devices and programmed to selectively illuminate at least some of the light emission devices in the array of light emission devices to form an arrangement of illuminated light emission devices;

a power source connected to and providing power to the array of light emission devices and to the logic circuit; and at least one input device connected to the logic circuit and operable to adjust the arrangement of illuminated light emission devices.

2. The light emitting head accessory of claim 1, wherein the array of light emission devices is selected from the group comprising a plurality of light emitting diodes ("LED"), a liquid crystal display ("LCD") panel, a plurality of light bulbs, an organic light emitting diode ("OLED") panel, and an electronic paper ("e-paper") display.

3. The light emitting head accessory of claim 1, further comprising:

a plurality of strands attached to the strip of flexible material, wherein the strands are positioned to hang downward below the strip of flexible material; and a second array of light emission devices attached to the strands, wherein the logic circuit is electrically coupled to and controls the second array of light emission devices.

4. The light emitting head accessory of claim 1, further comprising:

a first fastening device positioned on a first end of the strip of flexible material; and a second fastening device positioned on a second end of the strip of flexible material opposite the first end, wherein the first fastening device is configured to fasten with the second fastening device.

5. The light emitting head accessory of claim 1, further comprising a third fastening device attached to the strip of flexible material and configured to attach to another piece of headwear.

6. The light emitting head accessory of claim 5, wherein the third fastening device is a hook and loop fastener.

7. The light emitting head accessory of claim 5, wherein the third fastening device is a plurality of grommet holes.

8. The light emitting head accessory of claim 5, wherein the strip of flexible material is connected to an athletic hat by the third fastening device.

9. The light emitting head accessory of claim 6, wherein the strip of flexible material is connected to a beanie by the third fastening device.

10. The light emitting head accessory of claim 1, wherein the logic circuit is configured through depression of the at least one input device to illuminate the array of light emission devices to form the arrangement selected from the group comprising: blinking the array of light emission devices on and off continuously, scrolling a message across the array of light emission devices, displaying a static image, and displaying an animated image.

11. The light emitting head accessory of claim 10, wherein the message is an advertisement.

12. The light emitting head accessory of claim 1, wherein the logic circuit is configured through depression of the at least one input device to rotate between a plurality of different display arrangements by displaying each of the plurality of different arrangements for a set period of time and consecutively advancing to the next in the series of the plurality of different arrangements.

13. The light emitting head accessory of claim 1, further comprising a data connection device electrically coupled to the logic circuit.

14. The light emitting head accessory of claim 13, wherein the data connection device is selected from the group comprising: a wire, a communication port, and a wireless receiver.

15. The light emitting head accessory of claim 14, wherein the communication port comprises a Universal Serial Bus port.

16. The light emitting head accessory of claim 14, wherein the wireless receiver is a Bluetooth communication device.

17. A light emitting head accessory comprising:

a strip of flexible material having a front surface;

a first array of light emission devices positioned on the front surface, wherein the array includes a plurality of rows and columns of the light emission devices;

a plurality of strands of material attached to the strip of flexible material, wherein the strands are positioned to hang downward below the strip of flexible material;

a second array of light emission devices attached to the plurality of strands of material;

a logic circuit electrically coupled to the first array of light emission devices and to the second array of light emission devices and programmed to illuminate a first plurality of light emission devices in the first array of light emission devices and a second plurality of light emission devices in the second array of light emission devices, wherein the first plurality of illuminated light emission devices constitutes an arrangement selected from the group comprising text, images, animations, videos, and characters;

a power source connected to and providing power to the first array of light emission devices, the second array of light emission devices, and the logic circuit;

at least one input device connected to the logic circuit, wherein the at least one input device controls the arrangements displayed on the array of light emission devices;

a first fastening device positioned on a first end of the strip of flexible material; and a second fastening device positioned on a second end of the strip of flexible material opposite the first end, wherein the first fastening device is configured to fasten with the second fastening device to arrange the strip of flexible material into a closed loop.

18. The light emitting head accessory of claim 17, wherein the first array of light emission devices is selected from the group comprising a plurality of light emitting diodes, a liquid crystal display panel, a plurality of light bulbs, an organic light emitting diode panel, and an electronic paper display.

19. A method of displaying a graphical arrangement on a light emitting head accessory, the method comprising:

arranging a light emitting head accessory on a head of a person, the light emitting head accessory including a flexible strip of material forming a closed loop around the head;

receiving an input with an input device from a user;

determining with a logic circuit device a first graphical arrangement to be displayed; and displaying the first graphical arrangement with an array of light emission devices, the light emission devices being electrically coupled to the logic circuit and positioned on a front surface of the strip of flexible material.

20. The method of claim 19, wherein displaying occurs for a predetermined amount of time.

21. The method of claim 20, further comprising:

receiving a second input with an input device from the user;

determining with a logic circuit device a second graphical arrangement to be displayed; and displaying the second graphical arrangement with the array of light emission devices.

22. The method of claim 19, wherein receiving an input comprises receiving an input from an external device selected from the group comprising: a mobile telephone, a handheld computer, a smart phone, a portable digital assistant, a cellular telephone network, a satellite, and a remote control device.

23. The method of claim 22, wherein the input defines the first graphical arrangement.

24. The method of claim 22, further comprising determining if a subscription fee has been paid before displaying the first graphical arrangement.

* * * * *